United States Patent [19]

Loratto

[11] 4,018,585

[45] Apr. 19, 1977

[54] COOLED OR HEATED ENCLOSURE

[76] Inventor: Robert J. Loratto, 7331 Piney Branch Road, Takoma Park, Md. 20012

[22] Filed: Sept. 4, 1975

[21] Appl. No.: 610,231

[52] U.S. Cl. ..... 62/372; 62/383; 62/457; 62/466; 126/33; 126/204; 126/211; 165/80

[51] Int. Cl.[2] ..... F25D 3/08; F24C 15/10

[58] Field of Search ..... 62/295, 383, 457, 465, 62/466, 371, 372, 530, 531; 165/80; 126/33, 204, 211

[56] References Cited

UNITED STATES PATENTS

| | | | |
|---|---|---|---|
| 1,873,130 | 8/1932 | Jones et al. | 62/466 |
| 2,032,130 | 2/1936 | Jurkat et al. | 62/466 |
| 2,609,670 | 9/1952 | Wheeler et al. | 62/371 |
| 2,959,938 | 11/1960 | Giardini | 62/457 |
| 3,148,515 | 9/1964 | Jentis et al. | 62/371 |
| 3,286,483 | 11/1966 | Burg | 62/371 |
| 3,387,650 | 6/1938 | Hoffman et al. | 62/457 |
| 3,678,703 | 7/1972 | Cornish | 62/457 |
| 3,703,088 | 11/1976 | Moorhead | 62/459 |

*Primary Examiner*—Ronald C. Capossela
*Attorney, Agent, or Firm*—Beall & Jeffery

[57] ABSTRACT

A cooled enclosure comprising a container having side and end walls and a bottom wall which define an enclosure having an open top. A cover associated with the enclosure includes a heat conductive layer on at least the bottom surface thereof which faces the enclosure. Refrigerant means are positioned in the enclosure and supported therein by resilient supporting means which bias the refrigerant means into intimate contact with the bottom surface of the cover whereby the cooling effect of the refrigerant means is transferred by the layer to the outside surface of said cover.

11 Claims, 6 Drawing Figures

COOLED OR HEATED ENCLOSURE

BACKGROUND OF THE INVENTION

The present inventin relates as indicated to a cooled enclosure, and relates more particularly to a cooled enclosure particularly suitable for use with animals, particularly dogs, for the purpose of maintaining a cooled surface on which the dogs may sit in order to prevent the dogs from being exposed to conditions of undue heat.

In the showing of dogs or other animals at meets or contests, the behavior of the animals to a significant degree depends upon the environmental conditions at the time of the contest or just prior to the contest. Thus, it is well known by breeders and showers of dogs or other animals that high heat conditions prior to and at the show often adversely affect the showing of the dog, with the heat affecting both the appearance of the dog and its ability to perform in the contest. The contests are often held in locations which are not air conditioned and therefore subject to relatively high temperatures during the summer months. If the location is air conditioned, the temperature is frequently not sufficiently low so as to be conducive to optimum appearance and performance of the animal, and this applies to situations in which the animals are transported to the location of the meet in air conditioned vehicles.

SUMMARY OF THE INVENTION

The present invention relates to a cooled enclosure in which suitable cooling or refrigerating means are supported within the enclosure in such a manner as to maintain constant contact and thus heat exchange relation with the lid of the enclosure so as to maintain the outer surface of the lid or cover within a predetermined temperature range for a relatively long period of time. The animals can rest upon the enclosure enroute to their destination, for example, a show, and can likewise rest on such enclosure during the show thereby providing a substantially cooler environment than the surrounding ambient temperatures.

The invention is particularly characterized by the novel manner in which the cooling or refrigeration means is maintained in constant contact with the bottom surface of the lid or cover, which is closed when the invention is in use. The refrigerating means preferably comprise containers having a liquid therein which can be frozen before use of the invention and thereafter placed within the container on resilient means which continually bias the containers upwardly against the bottom of the lid or cover of the enclosure. Due to the difference in temperature between the refrigerating means and the ambient atmosphere, the resulting heat exchange eventually thaws the refrigerant but it has been found that the refrigerant can maintain the necessary temperature conditions within the enclosure for up to 10–12 hours, a period of time more than sufficient for transporting the animals to the desired location and maintaining the cooled condition during the show.

BRIEF DESCRIPTION OF APPLICATION DRAWINGS

In the Application Drawings

DETAILED DESCRIPTION OF THE PREFERRED EMBODIMENTS

Figure 1:
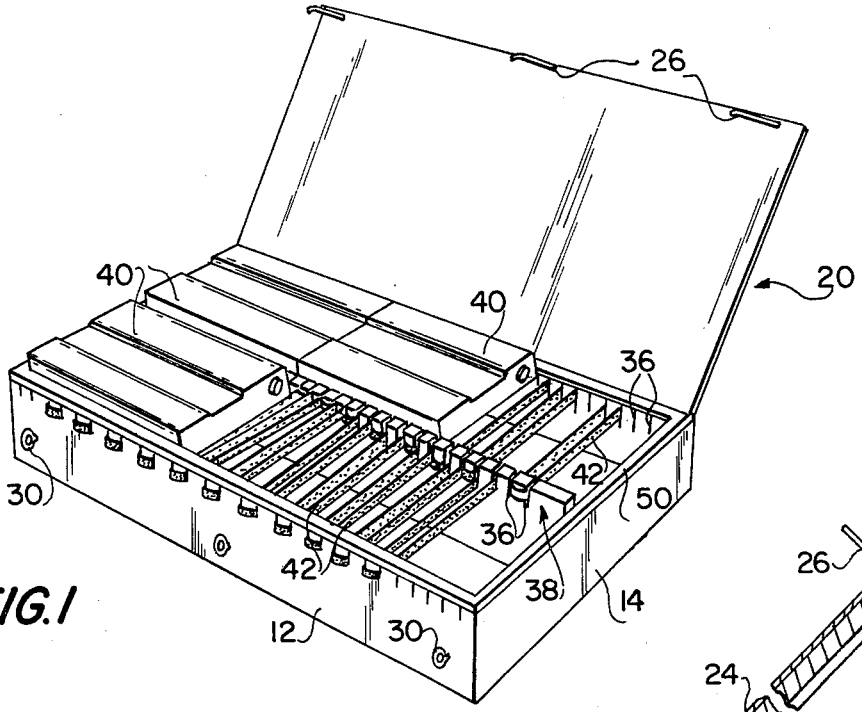
FIG. 1 is a perspective view of the invention, with the lid of the enclosure being shown in an open position and the refrigerating means occupying only a portion of the enclosure so as to expose the resilient supporting means for viewing in this figure.

Referring now in more detail to the application drawings, wherein like parts are indicated by like reference numerals, the enclosure comprises a box generally indicated in FIG. 1 which includes longitudinal side walls commonly indicated at 12, connecting end walls commonly indicated at 14 and a bottom wall 16. These components can be interconnected in any suitable manner and can be of any suitable material, for example, wood, which, when interconnected, define an enclosure open at the top. A layer of reflective aluminum foil 18 is preferably positioned on the top surface of the bottom wall 16.

A lid or cover generally indicated at 20 is hinged to one of the side walls 12 by a hinge 22 which in the form shown comprises a piano hinge although it will be apparent that other types of hinge means could be employed as well. The lid 20 can also be constructed of any suitable material, such as wood, and has mounted on the bottom surface thereof a layer of sheet metal 24 which can be secured to the undersurface of the lid or cover by any suitable means such as fasteners or the like. The sheet 24 can be made of any metal possessing the necessary heat transfer characteristics, and galvanized sheet steel and sheet aluminum are particularly satisfactory for this purpose.

Figure 4:
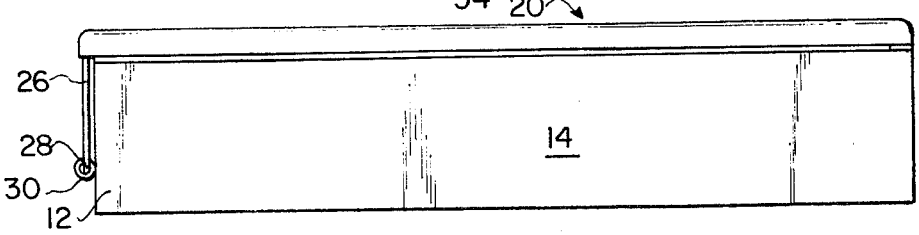
FIG. 4 is an end view of the enclosure, with the lid closed.

A plurality of male latch members commonly designated at 26 are mounted in spaced relation adjacent the outer end and on the underside of the cover 20, with the latch members including end portions which are in the form of hooks which can engage through eyes 28 formed in female latch members 30 mounted in corresponding spaced relation on the opposite longitudinal wall 12 whereby the cover 20 can be latched in a closed position fully covering the enclosure, as shown in FIGS. 1 and 4. It will be noted in these figures that the cover 20 is slightly wider than the side walls 14 whereby the latch members 26 do not interfere with the opening and closing movement of the cover.

Figure 3:
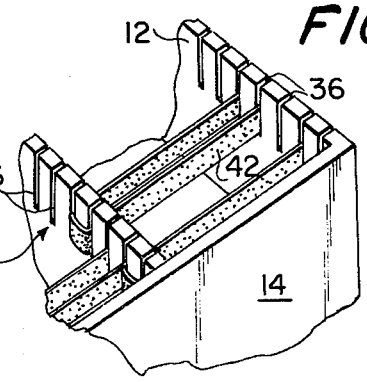
FIG. 3 is a perspective, fragmentary view showing the manner in which the preferred form of supporting means are mounted in the enclosure.

Each side wall 12 is formed with a plurality of slots commonly designated at 36, and a longitudinally extending dividing wall generally indicated at 38 is likewise formed with slots 36, with the spacing of the slots 36 in the dividing wall 38 corresponding to the spacing of the slots 36 in the side walls 12, with only one side wall 12 being shown in the fragmentary FIG. 3 view. The vertical divider 38 extends preferably the full length of the enclosure and can be secured in place in any suitable manner, and is likewise preferably formed of wood.

Refrigerating or cooling means in the form of individual containers commonly designated at 40 are resiliently supported in the enclosure 10 so as to be resiliently biased continually against the sheet metal layer 24 of the cover 20. A plurality of containers 40 are normally provided, with the dimension of the enclosure 10 shown in FIG. 1 accommodating six individual containers, three on each side of the vertical divider 38. The containers 40 are commercially available and typically constitute plastic containers having end caps 41 for filling the containers with refrigerant which can be frozen when the container is placed in a freezer prior to use of the container. The liquid normally comprises water mixed with a material substantially lowering the freezing point of the water, with the mixture being freezable at the normal temperature range found in domestic freezers. When the containers 40 are used after being properly frozen, they thaw out gradually and provide a cooling effect for several hours, making the containers ideal where it is desired to maintain cooling temperatures over a period of several hours. The specific construction of the containers and the composition of the liquid contained therein form no part of the present invention.

The containers 40 are resiliently supported within the enclosure 10 by means of circular bands commonly designated at 42 which, referring to FIG. 3, are positioned in opposed slots 36 formed in a side wall 12 and the vertical divider 38. The bands 42, which in the preferred form are made of rubber, are positioned in opposed slots, with the slots 36 having a depth sufficient to position the top surfaces of the bands in contact with the containers 40 so as to bias the containers upwardly so that firm engagement is made between the top surfaces of the containers and the sheet metal layer 24 on the cover 20. As shown in FIG. 3, the bands 42 shown extending between the side wall 12 and the divider 38 have interposed therebetween a band 42 which extends between the vertical divider and the opposite side wall 12 not shown in this figure. It will be understood that the slots can be spaced and have a depth as necessary to firmly yet resiliently support the containers 40 to achieve the desired heat exchange with the sheet metal layer 24 of the cover 20.

Figure 2:
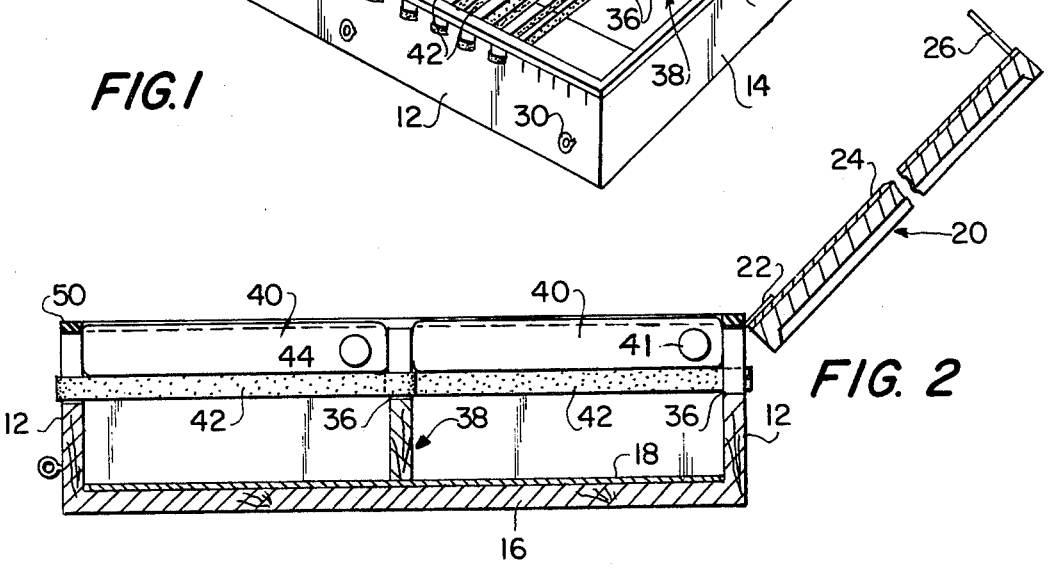
FIG. 2 is a vertical sectional view of the invention, with the lid likewise being shown in an open position, and more clearly illustrating the resilient support for the cooling means.

When the cover 20 is opened as shown in FIG. 2, the containers 40 are biased upwardly by the bands 42 to a position above the top surface of the side and end walls, and the subsequent closing of the cover 20 serves to tension or load the bands 42 whereby the bands continually bias the containers upwardly against the sheet metal layer secured to the cover. In this manner continuous contact is maintained between the containers 40 and the sheet metal as long as the cover 20 is maintained in closed position. The bands 42 can be made of elastomeric material such as rubber or other suitable material, although it will be noted that other forms of resilient support for the containers could likewise be used so long as the supporting means bias the containers 40 upwardly against the sheet metal layer attached to the cover. For example, the rubber bands 42 could be replaced by metal spring members mounted through th slots 36, with such spring members similarly functioning to continually bias the refrigerant containers 40 upwardly into contact with the sheet 24. Faomed rubber material supported on the bottom wall of the enclosure can also be used to resiliently support the refrigerant containers. Alternatively, a resilient plastic material, such as foamed polystyrene, could be positioned in the enclosure and dimensioned so as to support the refrigerating containers so as to bias the same upwardly, with the polystyrene being sufficiently resilient to be compressed by the closed cover and refrigerant containers when the cover is closed. In such form, the polystyrene, which is an insulating material, would serve the additional purpose of limiting the cooling effect of the refrigerant means through the cover 20. The polystyrene or foam rubber could also be used in the enclosure solely for insulating purposes, and positioned below the rubber bands 42 or other resilient supporting means for more efficiently transferring the cooling effect from the refrigerant means to the cover 20.

A sealing gasket 50 is mounted on the top surface of the side and end walls 12 and 14, respectively, so as to minimize leakage from the enclosure when the cover 20 is closed and latched.

In FIG. 1, three separate refrigerant containers are illustrated although it will be understood that in normal usage refrigerant containers will occupy the entire enclosure area and be supported by the rubber bands 42, with the refrigerant containers being positioned serially on each side of the vertical divider 38. It will be understood that the dimensions of the enclosure can be selected to receive the refrigerant containers in the most efficient manner with minimal wasted space. It will also be apparaent that the enclosure can be made smaller or larger as desired to accommodate any number of refrigerant containers depending upon the ultimate use to which the invention is put.

It will thus be seen that the invention is simple in construction and easy to manufacture. Slots 36 are formed in the side walls 12 and vertical divider 38 after which the latter is mounted in the enclosure. The rubber bands 42 are thereafter positioned in the slots 36 in the preferred longitudinal spacing, after which the cover 20 is hinged to one of the side walls 12. The sealing gasket 50 is thereafter mounted in place so as to seal the cover 20 when closed and latched through the latching members 26 and 28.

In use, the pre-frozen refrigerant containers are positioned in the enclosure on the rubber bands 42, with the top surfaces of the containers extending substantially above the top surfaces of the side and end walls 12 and 14 respectively. The cover 20 is then closed and latched, with the cover forcing the refrigerant containers 40 downwardly and tensioning the rubber bands 42 which continually bias the containers upwardly into contact with the metal sheet 24 of the cover. As the refrigerant containers thaw over an extended period of time, some reduction in thickness of the containers is realized, but the rubber bands 42 function to continually maintain contact between the refrigerant containers 40 and the layer 24. In this manner, the cooling effect from the refrigerant means is transferred through the metal sheet 24 to the top surface of the cover 20 to maintain such surface in a cooled condition within a fairly low temperature range. My experience has been that the cover 20 can be maintained in the range of 55° – 60° for a period of several hours. Thus, in the preferred use of the invention as above described, the cooled enclosure accomplishes the useful purpose of maintaining a support for animals, such as dogs, for a sufficiently long period to accommodate transportation of the animals to and from the place of showing and provide a cooled surface for the animals during the show. This is extremely important during conditions of relatively high ambient temperature and particularly where the location of the show and/or the transportation means are not air conditioned. If necessary, a towel or other type of moisture-absorbing material can be placed on and/or secured to the outer surface of the cover to prevent transfer of moisture to the animal .

It will be apparent that variations can be made from the above disclosure without, however, departing from the invention concepts. For example, the combination wood and sheet metal cover could be replaced by an entirely metal cover, with the cover being formed with peripheral flanges which extend upwardly from the surface of the cover. The flanges could extend upwardly to a substantial degree, for example, 4–6 inches so as to provide cooling effect for portions of the animals not directly contacting the main surface of the cover. It will also be apparent that means other than the latching members shown in the application drawings could be provided for maintaining the cover in a closed position.

Where foamed rubber or foamed polystyrene are employed for the resilient support of the refrigerating containers, rather than the rubber bands 42 or metal springs as above described, it will be apparent that the slots 36 formed in both side walls 12 and the vertical divider 38 could be eliminated, with the foamed material being supported by the bottom of the enclosure and being dimensioned in terms of thickness sufficiently to bias the refrigerant containers upwardly into contact with the bottom surface of the cover. In such modification, the vertical divider 38 is still preferably employed so as to equalize the pressure of the refrigerant containers acting on the under surface of the cover, although it will be understood that the vertical divider in such modification could be eliminated with reduced efficiency.

In still another modification, the lid or cover can be made to slide on the enclosure through the interfitting of longitudinal flanges formed on the cover with slots or recesses formed in the longitudinal side walls of the enclosure adjacent the top thereof.

Figure 5:
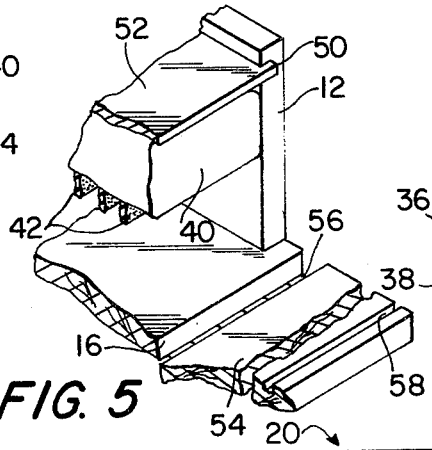
FIG. 5 is a fragmentary view of an alternative form of the invention.

Referring to FIG. 5, the side wall 12 is formed with a longitudinally extending groove or recess 50 adapted to receive the adjacent edge portion of a cover 52, which preferably is formed of metal. Although the fragmentary FIG. 5 view shows only one side wall 12, it will be understood that the opposed side wall 12 is similarly formed for receiving the opposite edge of the cover 52. The rubber bands commonly designated at 42 can be supported on the side wall 12 and the vertical divider (not shown) in the manner previously illustrated, or on separate retaining strips (not shown) which can be removably secured to each side wall and guided thereon by means of pins or the like which extend inwardly from the side walls through openings therfor in the strips.

In the FIG. 5 form, the side walls 12 and opposite end wall are fixed to the bottom wall 16, and the end wall 54 shown in FIG. 5 is hinged as shown at 56 to the bottom wall. In this manner, the end wall 54 can be dropped as illustrated to permit the cover 52 to be slid longitudinally in the container through interengagement of the edges of the cover with the grooves 50. The end wall 54 is preferably formed with a groove 58 which is aligned with the adjacent edge of the cover 52 when the end wall is raised after the cover is positioned in the side walls over the refrigerant containers 40. A seal or gasket (not shown) can be positioned in the groove 58 to provide a tighter seal with the adjoining edge of the cover 52 when the end wall 54 is closed and latched, by latching means (not shown).

The manner in which the FIG. 5 form of the invention is used should be apparent from the foregoing description. The refrigerant containers 40 are placed on the rubber bands 42 and sufficiently depressed, thereby tensioning the rubber bands 42, to permit the cover 52 to engage the opposed grooves 50 in the side walls 12. When the cover 52 is in its fully inserted position as shown in FIG. 5, the end wall 54 is raised, with the groove 58 formed therein receiving the adjoining edge of the cover 52. The end wall is then latched in its closed position, and the rubber bands 42, due to their being in tension, resiliently engage and bias upwardly the refrigerant containers 40 against the underside of the cover 52. In order to remove the refrigerant containers 40 for refreezing, the reverse procedure is followed.

Figure 6:
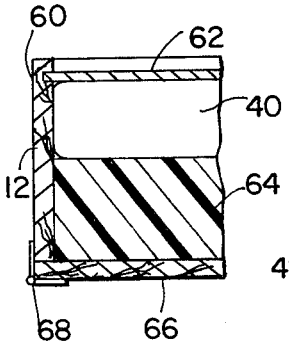
FIG. 6 is a fragmentary sectional view of a further modified form of the invention.

In still a further modification of the invention, the lid or cover can be fixed in position relative to the side and end walls, and the bottom wall hinged or otherwise removably mounted on the enclosure, for example through the groove arrangement just described in connection with the installation of the cover as shown in the FIG. 5 form of the invention. Referring to FIG.6, a fragmentary cross sectional view through such further modification, the side wall 12 is formed with a groove 60, with the lateral side edges of the cover 62 being tightly received in the groove. The opposite side wall and the end walls are similarly constructed whereby the cover 62 can be made to tightly fit within the side and end walls during assembly of the enclosure.

In the FIG. 6 form, the refrigerant containers 40 are biased upwardly against the bottom surface of the cover 62, which is preferably of metal, by means of a resilient foam material 64, the thickness of which is selected so as to continually bias the refrigerant containers upwardly into contact with the cover. The bottom wall 66 of the enclosure is hinged to the side wall 12 by hinge means 68 so as to permit the bottom wall to be swung away from the enclosed space for removal of the foam material to provide access to the refrigerant containers 40 for refreezing the same. It will be understood that latching means (not shown) are provided for latching the bottom wall 66 in the closed position thereof. It will be also understood that the bottom wall 66 can, rather than being hinged as shown, be slid into grooves formed therefor (not shown) in the side walls, with such modification requiring that one of the end walls be somewhat abbreviated in height to permit access of the grooves by the bottom wall.

In the use of the FIG. 6 form of the invention, the enclosure is inverted from the orientation shown in FIG. 6, and the bottom wall 66 unlatched and opened. The foam material 64 can thereafter be removed and the refrigerant containers replaced after being refrozen or with other frozen containers. The foam material is then repositioned over the refrigerant containers, with the thickness of the foam material in its uncompressed state being greater than the distance between the bottom of the refrigerant containers and the top surface of the bottom wall when closed. The bottom wall is thereafter pivoted to a close position and latched, with the closure of the bottom wall compressing the foam material 64 so as to bias the material upwardly against the refrigerant containers and the latter, in turn, against the bottom surface of the cover 62. In this manner, the cover 62 can be kept cool in accordance with the desired objectives of the invention.

Although the above description is directed toward the desired result of providing a cooling effect for the animals positioned on the enclosure cover, it will be understood that the refrigerant containers could be replaced by heated containers where the ambient conditions are such that additional heat is desired for the animals. The cover in such instance would provide a warm surface for the animals due to the resilient support for the heated containers and the resulting heat exchange contact between the containers and the bottom surface of the cover. The material in the containers to be heated can be liquid or solid and forms no part of the invention concepts.

I claim:

1. A cooled enclosure comprising
   a. side and end walls and a bottom wall which define an enclosure, said side walls being formed with spaced generally vertical extending slots,
   b. a vertical divider positioned in said enclosure generally intermediate said side walls, with said divider being generally intermediate the side walls and formed with slots generally aligned with the slots in said side walls;
   c. a cover associated with said enclosure and covering the same, said cover being formed of a heat conductive material on at least its bottom surface,
   d. refrigerant means positioned in the enclosure, and
   e. means mounted in said enclosure for supporting said refrigerant means and biasing the same into intimate contact with the bottom surface of said cover whereby the cooling effect of said refrigerant means is transferred to said cover; said means for supporting and biasing said refrigerant means comprising a plurality of rubber bands each of which extends between said divider and one of said side walls for resiliently supporting said refrigerant means.

2. The cooled enclosure of claim 1 wherein said bottom wall is lined with a reflective foil material.

3. The cooled enclosure of claim 1 wherein said cover includes a heat conductive layer comprised of a thin plate of galvanized steel or aluminum, and wherein the remainder of said cover is formed of wood.

4. The cooled enclosure of claim 1 wherein said cover is hinged to one of said side walls and has a width greater than the width of said end walls whereby the end of said cover extends beyond the side wall remote from the hinge for said cover, and latching means provided on said cover and said remote side wall for latching the cover in a closed position.

5. The cooled enclosure of claim 1 wherein said refrigerant means comprises a plurality of individual containers each of which contains a refrigerant mixture which can be pre-frozen and thereafter positioned in said enclosure on said rubber bands.

6. The cooled enclosure of claim 5 wherein said rubber bands are so positioned in said enclosure that the pre-frozen containers extend above the top surfaces of said side and end walls, with the rubber bands being thereafter tensioned when said cover is closed and latched.

7. A cooled enclosure comprising
   a. side and end walls and a bottom wall which define an enclosure, said bottom wall being separately formed and slidable in grooves formed in said side walls,
   b. a cover formed of a heat conductive material on at least its bottom surface and fixed to said side and end walls,
   c. refrigerant means positioned in the enclosure, immediately below said cover, and
   d. resilient means mounted in said enclosure for supporting said refrigerant means and biasing the same into intimate contact with the bottom surface of said cover whereby the cooling effect of said refrigerant means is transferred to said cover, the removal of said bottom wall when said enclosure is inverted permitting said refrigerant means to be positioned in the enclosure in contact with said fixed cover.

8. A cooled enclosure comprising
   a. side and end walls and a bottom wall which define an enclosure, said side walls being formed with longitudinally extending grooves relatively adjacent the tops thereof, and one of said end walls being hinged to said bottom wall to permit dropping of said one end wall to facilitate sliding movement of a cover means into the enclosure,
   b. a cover formed of a heat conductive material on at least its bottom surface, and slidable into said grooves formed in said side walls when said end wall is dropped, the subsequent raising of said end wall to a closed position serving to maintain said cover in said grooves,
   c. refrigerant means positioned in the enclosure immediately below said cover, and
   d. resilient means mounted in said enclosure between said bottom wall and said refrigerant means for supporting said refrigerant means and biasing the same into intimate contact with the bottom surface of said cover whereby the cooling effect of said refrigerant means is transferred to said cover.

9. A cooled enclosure comprising
   a. side and end walls and a bottom wall which define an enclosure, said bottom wall being hinged to one of said side walls and provided with latch means for latching the same in a position continguous the adjacent edges of said side and end walls,
   b. a cover associated with said enclosure and covering the same, said cover being fixed to said side and end walls and formed of a heat conductive material on at least its bottom surface,
   c. refrigerant means positioned in the enclosure, and
   d. means mounted in said enclosure for supporting said refrigerant means and biasing the same into intimate contact with the bottom surface of said cover whereby the cooling effect of said refrigerant means is transferred to the outside surface of said cover, said means for supporting and biasing said refrigerant means comprising resilient material positioned between said refrigerant means and said bottom wall, the thickness of said refrigerant means and said resilient material being such that said resilient material is compressed when said bottom wall is closed and latched thereby to resiliently press said refrigerant means against and in intimate contact with the bottom surface of said cover.

10. The enclosure of claim 9 wherein said resilient material comprises foamed material.

11. A heated enclosure comprising
   a. side and end walls and a bottom wall which defines an enclosure, said bottom wall being hinged to one of said side walls and provided with latch means for latching the same in a position continguous the adjacent edges of said side and end walls, b. a cover associated with said enclosure and covering the same, said cover being fixed to said side and end walls and formed of a heat conductive material on at least its bottom surface, c. heating means positioned in the enclosure, and d. means mounted in said enclosure for supporting said heating means and biasing the same into intimate contact with the bottom surface of said cover whereby the heating effect of said heating means is transferred to said cover, said means for supporting and biasing said heating means comprising resilient foamed material positioned between said heating means and said bottom wall, the thickness of said heating means and said foamed material being such that said foamed material is compressed when said bottom wall is closed and latched thereby to resiliently press said heating means against and in intimate contact with the bottom surface of said cover.

* * * * *